US007104414B2

(12) United States Patent
Apps et al.

(10) Patent No.: US 7,104,414 B2
(45) Date of Patent: Sep. 12, 2006

(54) COLLAPSIBLE CONTAINER

(75) Inventors: William P. Apps, Alpharetta, GA (US); Robert V. Gruber, Dallas, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/047,169

(22) Filed: Jan. 12, 2002

(65) Prior Publication Data

US 2003/0132228 A1 Jul. 17, 2003

(51) Int. Cl.

| | |
|---|---|
| ***B65D 6/12*** | (2006.01) |
| ***B65D 6/16*** | (2006.01) |
| ***B65D 6/28*** | (2006.01) |
| ***B65D 8/14*** | (2006.01) |

(52) U.S. Cl. ..... 220/6; 220/7

(58) Field of Classification Search ..... 220/6, 220/7, 4.28

See application file for complete search history.

(56) References Cited

U.S. PATENT DOCUMENTS

| | | | | |
|---|---|---|---|---|
| 3,970,209 A | | 7/1976 | Baxter | |
| 4,081,099 A | | 3/1978 | Shead | |
| 4,163,495 A | | 8/1979 | Drader | |
| 4,186,841 A | | 2/1980 | Buckley et al. | |
| 4,674,647 A | | 6/1987 | Gyenge et al. | |
| 4,735,330 A | | 4/1988 | Hoss | |
| 4,735,331 A | | 4/1988 | Keenan et al. | |
| 4,917,255 A | * | 4/1990 | Foy et al. | 220/6 |
| 5,076,457 A | | 12/1991 | Marovskis | |
| 5,094,356 A | * | 3/1992 | Miller | 220/7 |
| 5,398,834 A | | 3/1995 | Umiker | |
| 5,398,835 A | | 3/1995 | Blinstrub | |
| 5,467,885 A | | 11/1995 | Blinstrub | |
| 5,474,197 A | | 12/1995 | Hillis et al. | |
| 5,515,987 A | | 5/1996 | Jacques et al. | |
| 5,538,153 A | | 7/1996 | Marovskis et al. | |
| 5,632,392 A | * | 5/1997 | Oh | 220/7 |
| 5,746,342 A | * | 5/1998 | Jacques et al. | 220/6 |
| 5,788,103 A | | 8/1998 | Wagner et al. | |
| 5,829,617 A | * | 11/1998 | Umiker | 220/6 |
| 5,853,099 A | | 12/1998 | Lessard | |
| 5,938,059 A | | 8/1999 | Luburic | |
| 5,975,324 A | | 11/1999 | Schmitt | |
| 5,988,420 A | | 11/1999 | Jacques et al. | |
| 6,015,056 A | | 1/2000 | Overholt et al. | |
| 6,073,790 A | | 6/2000 | Umiker | |
| 6,098,827 A | * | 8/2000 | Overholt et al. | 220/6 |
| 6,189,695 B1 | | 2/2001 | Ching-rong | |
| 6,286,701 B1 | * | 9/2001 | Umiker | 220/6 |

(Continued)

FOREIGN PATENT DOCUMENTS

| | | |
|---|---|---|
| DE | 27 34 964 A | 2/1979 |

(Continued)

*Primary Examiner*—Nathan J. Newhouse
*Assistant Examiner*—Harry Grosso

(57) ABSTRACT

A collapsible container has a base having a lower hinge portion which includes a first lower hinge portion and a second lower hinge portion. The container also includes a plurality of upstanding side walls attached to the base having an upper hinge portion extending downwardly. The upper hinge portion includes a first elongate upper hinge portion and a second elongate upper hinge portion. The first lower hinge portion includes a first opening for receiving the first elongate upper hinge portion therein and also includes a flange for securing the first upper hinge portion thereunder. The second lower hinge portion includes a second opening correspondingly sized to receive the second elongate upper hinge member therein for limiting lateral movement between the side walls and the base.

28 Claims, 8 Drawing Sheets

U.S. PATENT DOCUMENTS

| | | | | |
|---|---|---|---|---|
| 6,293,418 | B1 * | 9/2001 | Ogden et al. | 220/7 |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| 6,460,717 | B1 * | 10/2002 | Smyers et al. | 220/6 |
| 6,631,822 | B1 | 10/2003 | Overholt | |
| 2002/0108950 | A1 | 8/2002 | Moorman et al. | |
| 2003/0116564 | A1 | 6/2003 | Overholt et al. | |
| 2003/0132228 | A1 | 7/2003 | Apps et al. | |

FOREIGN PATENT DOCUMENTS

| | | | |
|---|---|---|---|
| DE | 91 03 975.4 | U1 | 4/1991 |
| EP | 0 073 357 | A2 | 3/1983 |
| EP | 0 385 914 | A1 | 9/1990 |
| EP | 0 404 041 | A1 | 12/1990 |
| EP | 0 602 575 | A2 | 12/1993 |
| EP | 0 690 003 | A1 | 1/1996 |
| EP | 0 705 764 | A2 | 4/1996 |
| EP | 0 785 139 | A1 | 11/1996 |
| EP | 0 785 142 | A1 | 7/1997 |
| EP | 0 962 394 | A1 | 12/1999 |
| EP | 0 962 396 | A1 | 12/1999 |
| EP | 1 114 779 | A2 | 7/2001 |
| EP | 1 182 139 | A2 | 2/2002 |
| JP | 2001-130554 | * | 5/2001 |
| WO | WO 97/26190 | A2 | 7/1997 |
| WO | WO 97/49613 | A1 | 12/1997 |
| WO | WO 02/034630 | A1 | 5/2002 |
| WO | WO 03/078259 | A1 | 9/2003 |

* cited by examiner

COLLAPSIBLE CONTAINER

BACKGROUND OF THE INVENTION

1. Field of the Invention

The present invention relates to a collapsible container for storing and handling goods.

2. Background Art

Typical collapsible containers have a base member and four attached walls which fold relative to the base member by way of hinges. The walls are received by the base member to allow for relative pivoting between the walls and the base member. However, when the walls are assembled to the base, there often exists some movement or "play" between the wall and base after assembly. This is attributable to the existence of a relatively large amount of clearance in the hinge receiving area of the base which allows the wall to be inserted and also detached from the base member.

Further, the walls are usually attached to each other by way of latching mechanisms. While present latching mechanisms are functional, they may not provide adjacent side walls with both a secure attachment when in the assembled position, and also the capability to become unlatched efficiently by a user in order to move to the folded position. Accordingly, an improved collapsible crate is desired which has a hinge which securely mounts the walls to the base with nominal or no resulting play therebetween. The collapsible container should also provide a latch mechanism which is secure but is also unlatched with minimal and efficient handling and user effort.

SUMMARY OF THE INVENTION

It is an object according to the present invention to provide a collapsible container having a hinge assembly that impedes any post-assembly relative movement between the walls and the base.

It is another object according to the present invention to provide a collapsible container having a latch mechanism which provides for a secure assembled container, but also is capable of being unlatched with minimal handling and sufficient force.

In keeping with the goals and objects of the present invention, a collapsible container is provided which has a base with a lower hinge portion which includes a first lower hinge portion and a second lower hinge portion. The container also includes a plurality of upstanding side walls attached to the base having an upper hinge portion extending downwardly. The upper hinge portion includes a first elongate upper hinge portion and a second elongate upper hinge portion. The first lower hinge portion includes a first opening for receiving the first elongate upper hinge portion therein and also includes a flange for securing the first upper hinge portion thereunder. The second lower hinge portion includes a second opening correspondingly sized to receive the second elongate upper hinge member therein for limiting lateral movement between the side walls and the base. The second upper hinge member preferably has a cylindrical cross-section for allowing it to pivot easily, while giving away little or no lateral movement between the walls and the base.

The collapsible container also includes a latch assembly having a striker portion and a receiver portion, wherein the striker portion and receiver portion preferably have corresponding shaped angled or beveled surfaces for enhancing the assembly and release of the striker within the receiver.

The above object and other objects, features and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
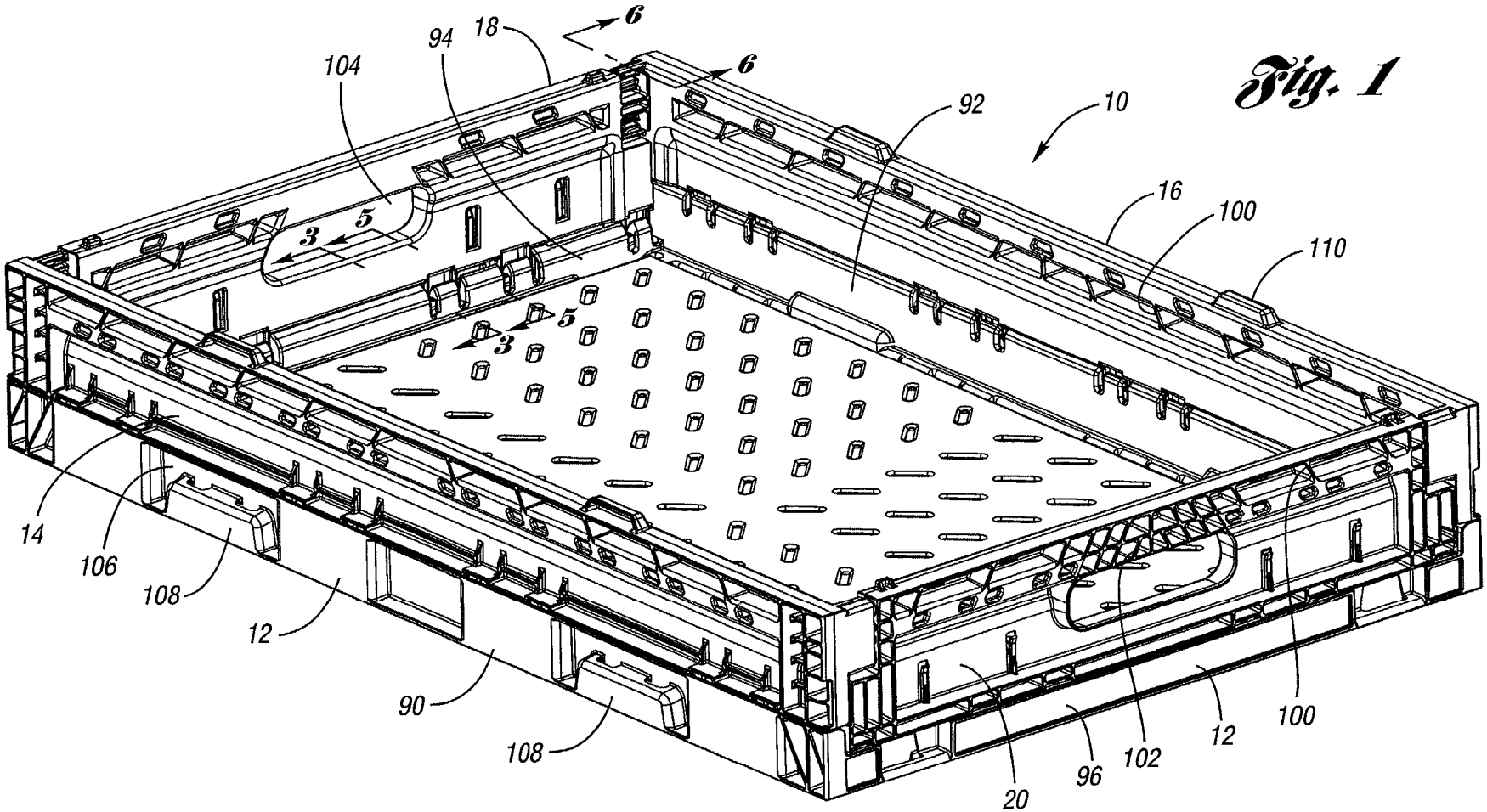
FIG. 1 is a perspective view of a collapsible container according to the present invention.
Figure 2:
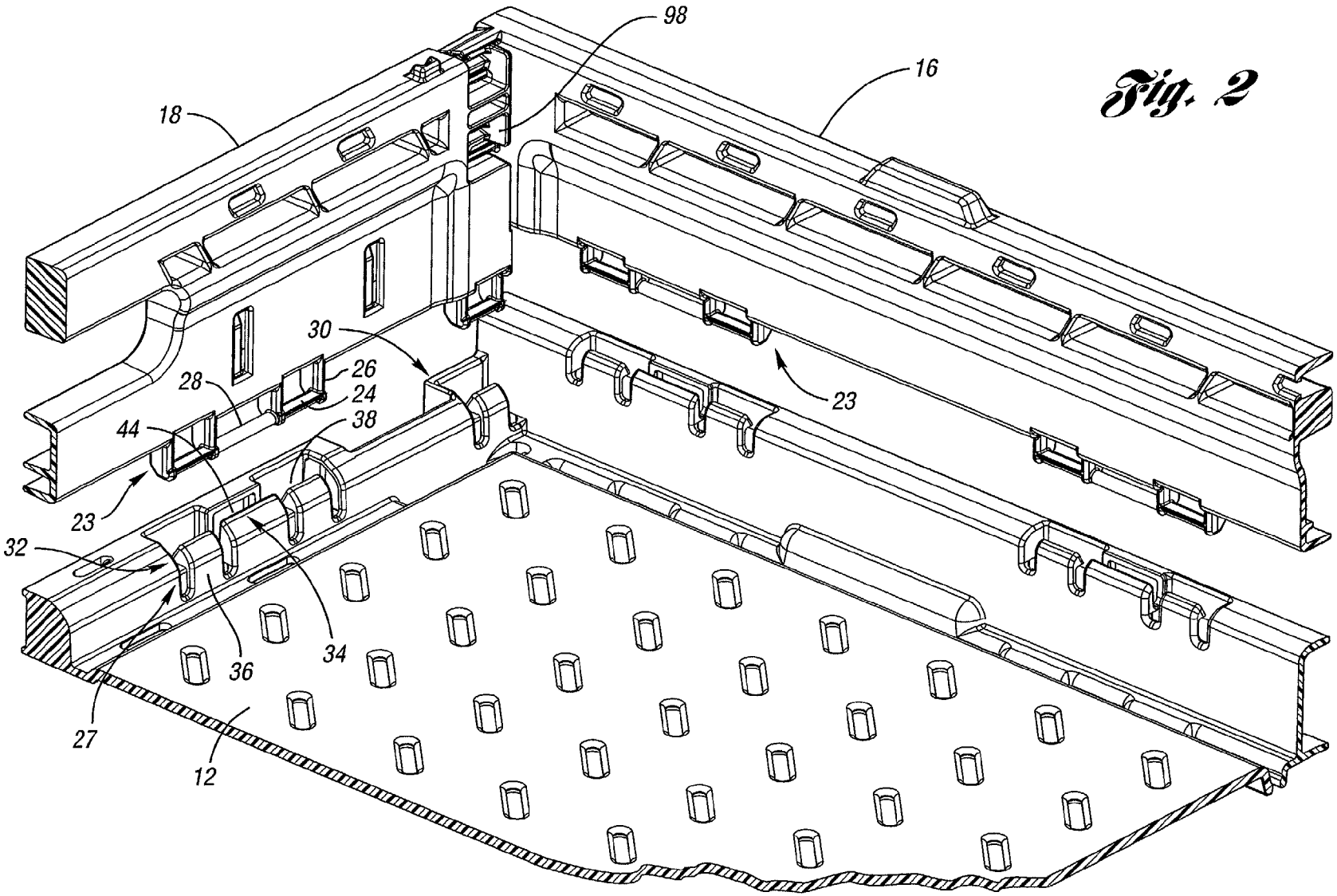
FIG. 2 is a partial, exploded perspective view of the container from its interior, wherein the walls are separated and spaced apart from the base.
Figure 3:
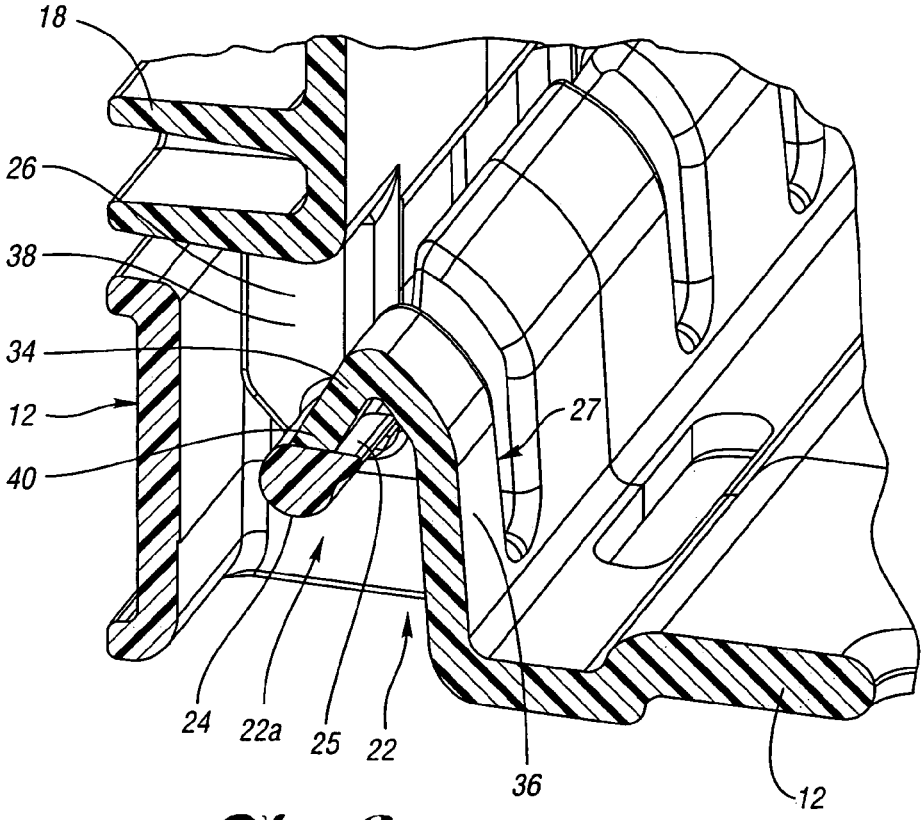
FIG. 3 is a partial cross-sectional view taken along line 3—3 of FIG. 1.
Figure 4:
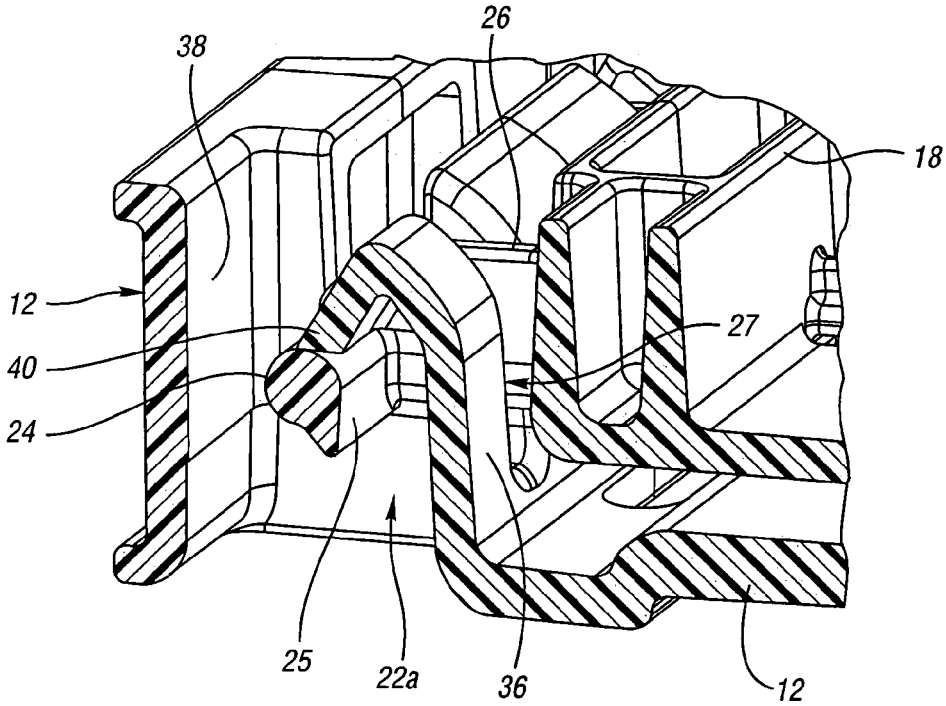
FIG. 4 is a view similar to FIG. 3, with the wall in the collapsed position.
Figure 5:
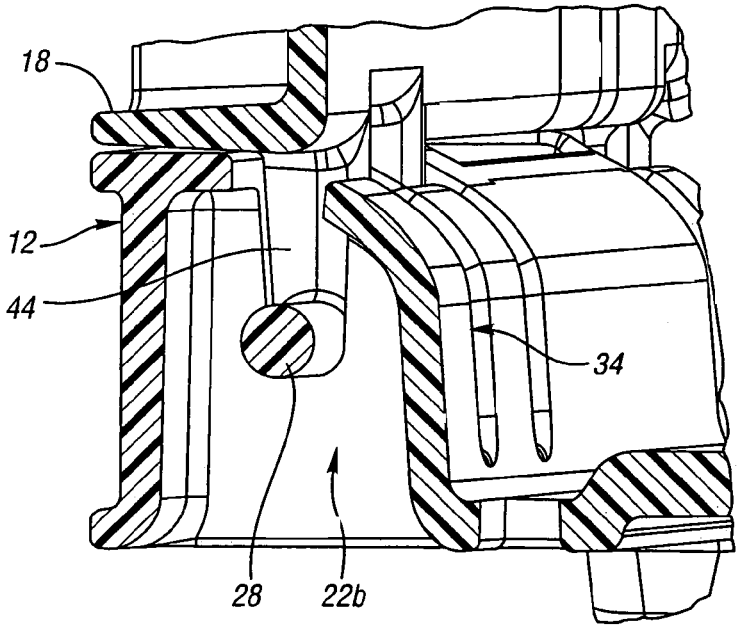
FIG. 5 is a partial cross-sectional view taken along line 5—5 of FIG. 1.

FIGS. 1–11 illustrate a collapsible container 10 in accordance with the present invention. As shown in FIG. 1, container 10 includes a generally horizontal base 12 and four walls 14, 16, 18, 20 pivotally attached to the base. Container 10 is generally symmetrical about each center line, and while shown as rectangular may also be square or other configurations without departing from the teachings herein. Walls 14 and 16 are generally referred to as side walls while walls 18 and 20 are referred to as end walls. Container 10 is collapsible between an assembled orientation where the walls are upstanding from the base (FIG. 1), and a collapsed orientation (FIG. 4.) Container 10 is typically formed of a polymeric material such as polypropylene via an injection molding process, but may be formed from other materials and processes without detracting from the teachings herein. As shown in FIGS. 2–5, walls 14–20 and base 12 have corresponding and mating hinge members which are attached to form hinge assemblies 22. FIGS. 3–4 illustrate partial cross-sectional views of a first hinge portion 22*a* of hinge assembly 22 taken generally along the line 3—3 of FIG. 1, where FIG. 3 illustrates the first hinge portion when the corresponding wall 18 is oriented upright in an assembled orientation. FIG. 4 illustrates the first hinge portion 22*a* of hinge assembly 22 in a cross-sectional view taken along a line similar to that shown in FIG. 3, but with the corresponding wall 18 in the inwardly collapsed position. First hinge portion 22*a* includes first upper hinge portion 24 and first lower hinge portion 27. FIG. 5 illustrates a second hinge portion 22*b* of hinge assembly 22 having a second upper hinge portion 28 and a second lower hinge portion 34.

As shown in FIG. 2, each wall 14–20 has a lower edge having an upper hinge portion 23 extending downwardly therefrom. Upper hinge portion 23 includes a plurality of first upper hinge portions 24 having a generally cam-shaped cross-section, as illustrated in FIGS. 3 and 4. First upper hinge portions 24 are supported by downwardly extending arms 26 attached to the lower edge of the respective wall member. Upper hinge portion 23 also includes one or more second upper hinge members 28 disposed between at least one pair of adjacent first upper hinge members 24. Second upper hinge members 28 more particularly extend between adjacent arms 26 as illustrated in FIG. 2. As shown in FIG. 5, second upper hinge member 28 has a cylindrical cross-section and, in association with second lower hinge portion 34, serves to minimize or prevent any slight movement or play between walls and base 12 upon assembly. As illustrated in FIGS. 1 and 2, each wall 14–20 has a plurality of first upper hinge portions 24, including proximate the corner area 30 of base 12.

Base 12 includes a plurality of lower hinge portions 32 for receiving upper hinge portions 23 therein. More particularly, base 12 includes a first lower hinge portion 27 for receiving therein and securing first upper hinge portion 24. Base 12 also includes a second lower hinge portion 34 for receiving second upper hinge portion 28. First lower hinge portion 27 includes a upstanding receiver arm 36 having a generally open area 38 therearound. Arm member 36 includes an upper portion having a downwardly extending flange 40. As further illustrated in FIG. 4, the upper hinge configuration 23 is designed to assemble to base 12 when in the inwardly folded position. Accordingly, the cross-section of first upper hinge member 24 includes a generally flat surface 25. As the flat surface 25 of first upper hinge member 24 is downwardly inserted into area 38, flat surface 25 exerts a slight interference with flange 40, causing flange 40 to flex and deform slightly inward, allowing first upper hinge member 24 to move downwardly past and below flange 40. Subsequently, flange 40 returns to its normal, unbiased position as shown in FIG. 3, as the corresponding wall member 18 is pivoted upwards to its assembled orientation. In its normal position, flange 40 acts as a stop to provide interference for upper hinge portion 24 and keep it securely retained to base 12.

With reference to FIG. 5, second upper 28 and lower hinge portions 34 are shown therein. During assembly as shown in FIG. 4, second upper hinge portion 28 is received securely within a recessed area 44 of second lower hinge portion 34. Recessed area 44 is sized to receive second upper hinge portion 28 securely and therein. The snug fit between second upper and lower hinge portions 28, 34 of hinge assembly 22 serve to impede the play of the walls relative to the base found in many prior art containers. Recessed area 44 is correspondingly sized to receive the second elongate upper hinge member 28 therein in a slight interference fit for limiting lateral movement between the side walls and the base. The second upper hinge member 28 preferably has a cylindrical cross-section for allowing it to pivot easily even with its secure fit, while giving away little or no lateral movement between the walls and the base.

Figure 6:
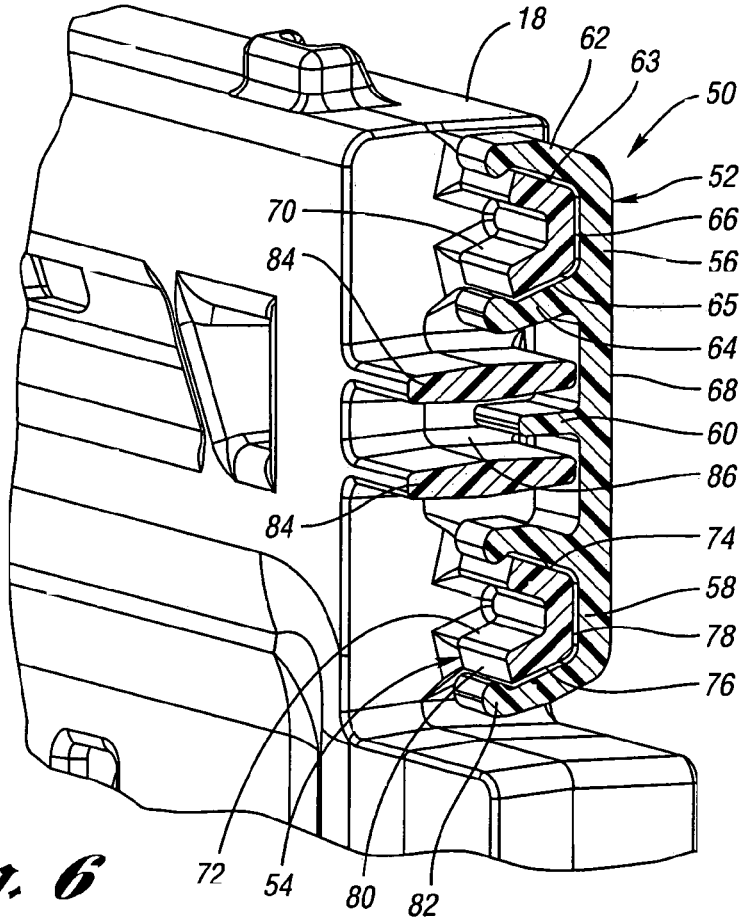
FIG. 6 is a partial cross-sectional view taken along line of FIG. 1.
Figure 7:
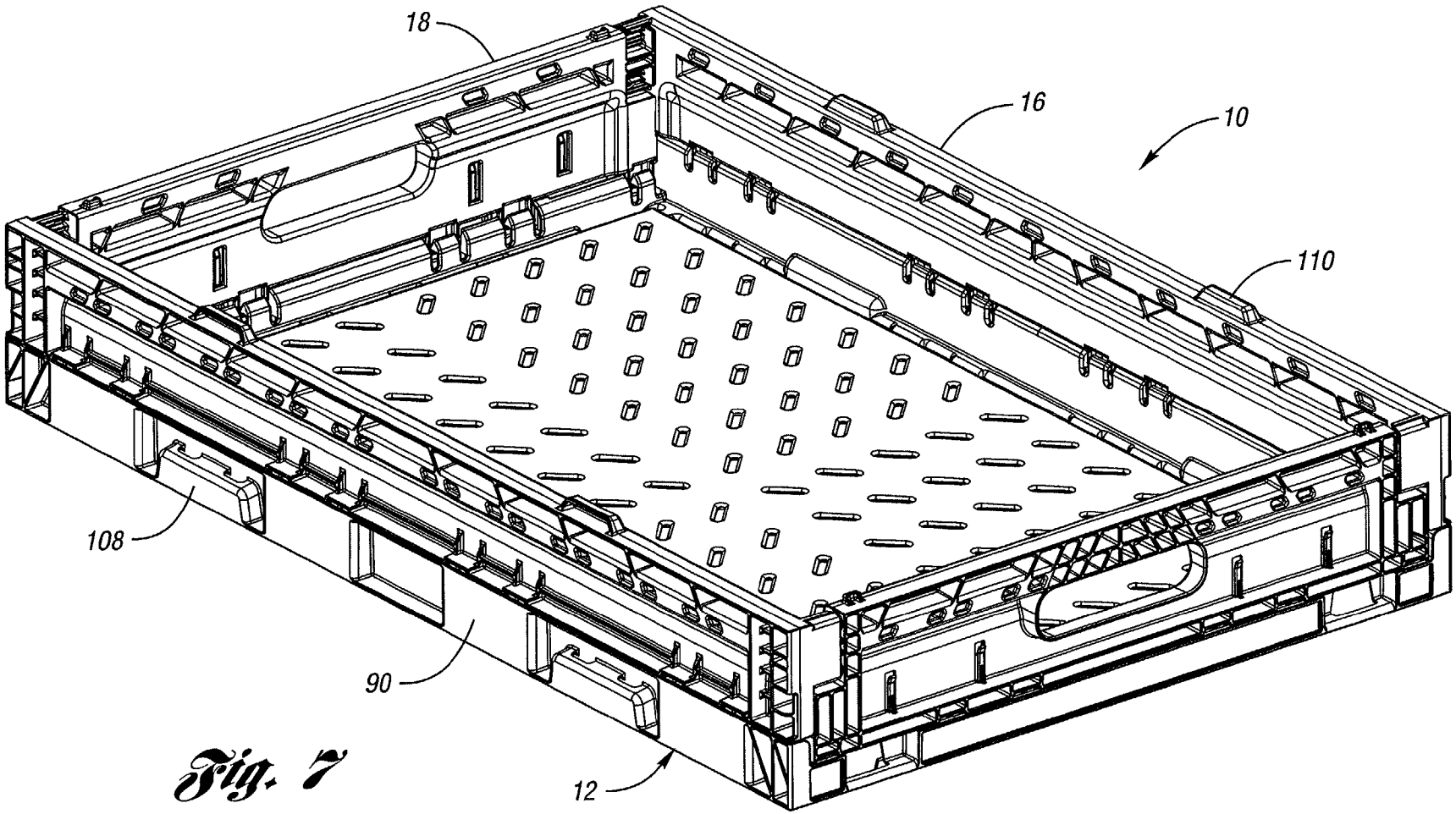
FIG. 7 is another perspective view of the container of FIG. 1.
Figure 8:
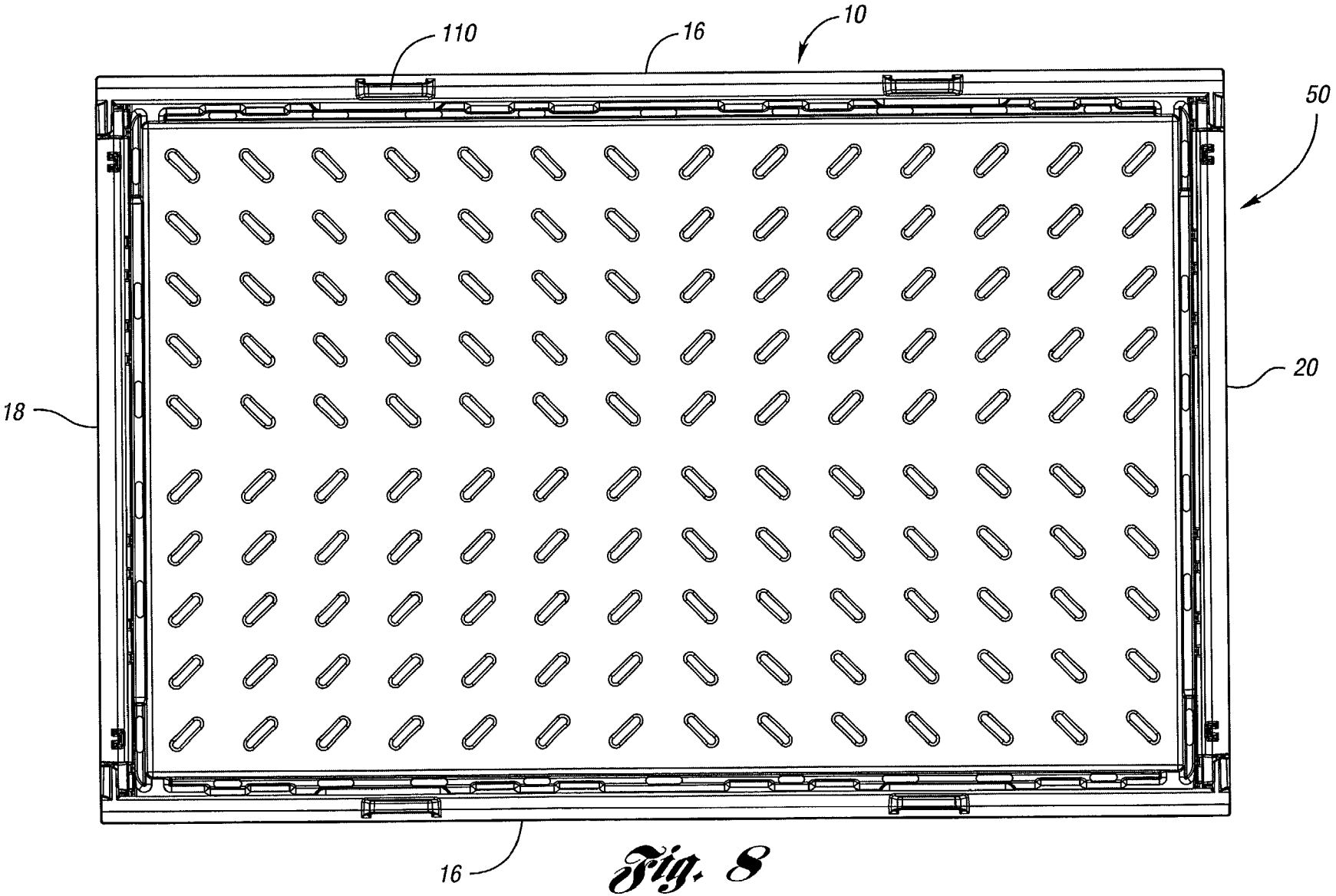
FIG. 8 is a top plan view of the container of FIG. 1.
Figure 9:
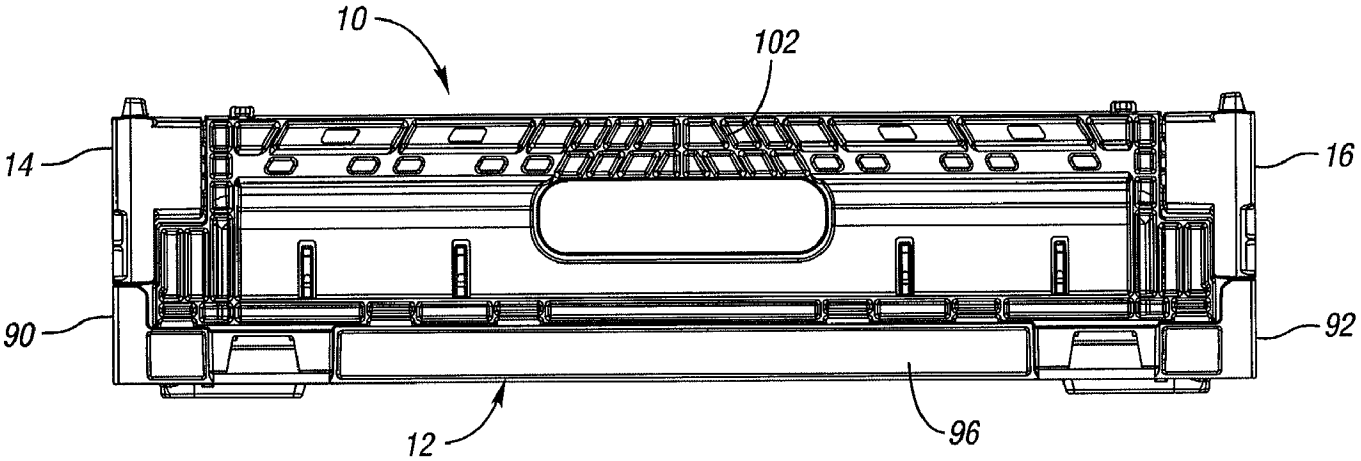
FIG. 9 is a right side elevational view of the container of FIG. 1, wherein the left side is a mirror image thereof.
Figure 10:
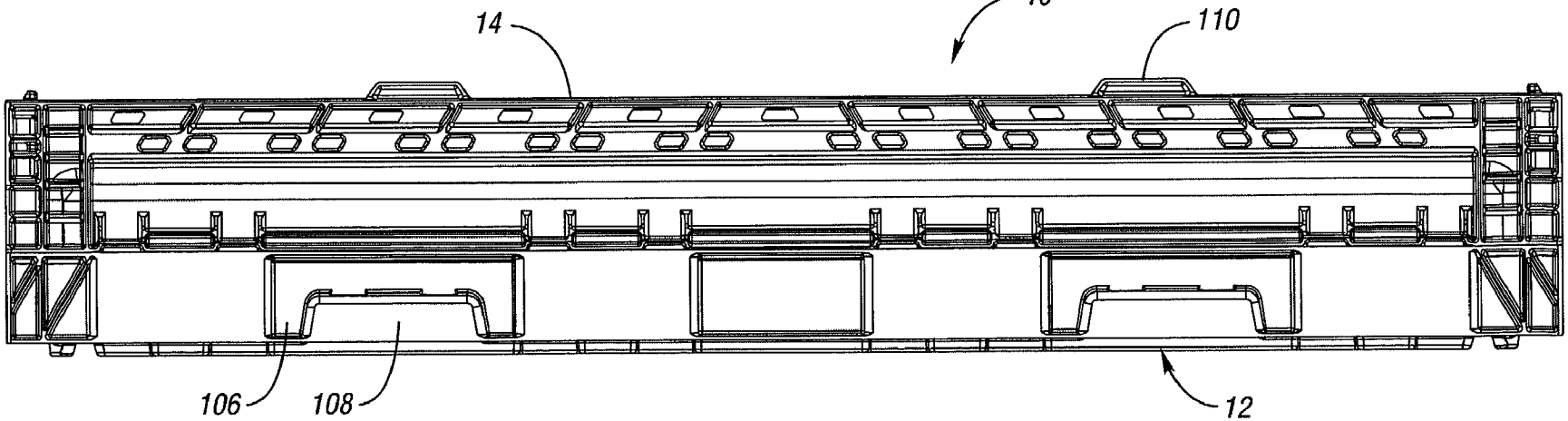
FIG. 10 is a front side elevational view of the container of FIG. 1, wherein the rear side is a mirror image thereof.
Figure 11:
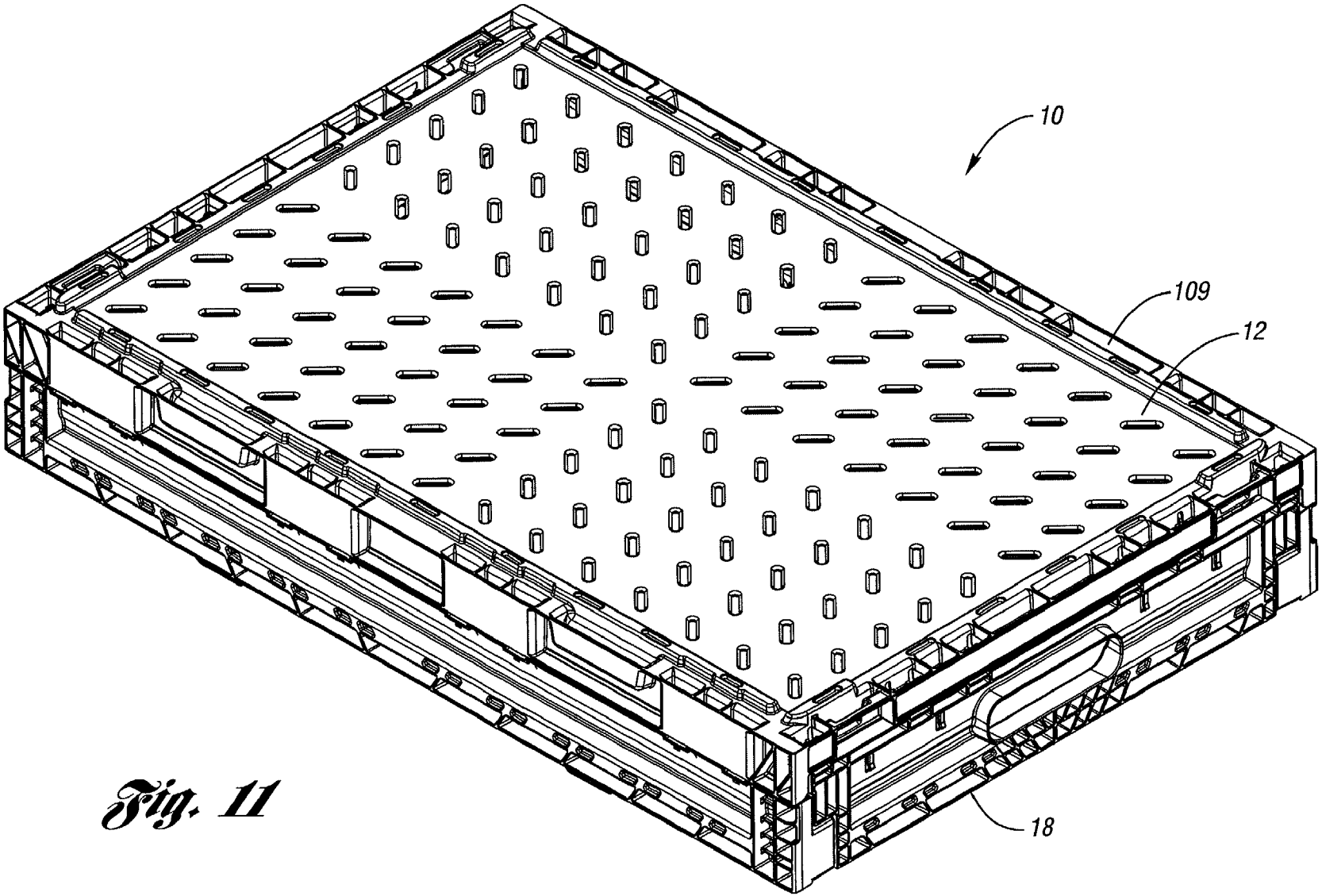
FIG. 11 is a bottom perspective view of the container of FIG. 1.

FIG. 6 illustrates a partial cross-sectional view of latch assembly 50 in an assembled orientation. Latch assembly 50 includes a latch receiver portion 52 formed as a unitary construction with side walls 14, 16. Latch assembly 50 also includes a latch striker portion 54 formed as a unitary construction with end walls 18,20 and which is received by the latch receiver portion 52 when assembled. By way of example, latch receiver portion 52 includes an upper receiver portion 56, a lower receiver portion 58 and an alignment portion 60. Upper and lower receiver portions 56, 58 have angled upper and lower arms 62, 64 having corresponding inner surfaces 63,65 with a generally flat rear inner surface 66 oriented parallel with receiver outer surface 68.

Striker portion 54 includes upper and lower striker portions 70,72 which have corresponding outer beveled surfaces 74, 76, corresponding to angled receiver surfaces 63,65. Striker portions 70,72 also include a generally flat rear surface 78 which corresponds to the receiver rear surface 66.

Container 10 is generally of the knock-down type, wherein the walls are unlatched and folded inwardly by applying external forces to the wall, as opposed to manually actuating the latch member. Accordingly, as end wall 18 is raised into the assembled position, striker portions 70,72 enter the openings defined by receiver portions 56,58. Opposed arms 62,64 of receiver portions 56,58 are slightly flexible such that, as striker angled surfaces 74,76 apply a slight force to the interior of arms 62,64, the ends thereof slightly deform and open slightly for fully receiving striker portions 56,58 therein. Subsequently, arms 62,64 of receiver portions 56,58 return to their unbiased position, thereby securing strikers 70,72 therein. As shown, strikers have a generally flat end surface 80. To fold end walls 18,20 inward, a predetermined amount of force is applied against the external surface of end wall 18, 20, thereby causing striker portions 56,58 (end surfaces 80) to exert pressure against the bulbous ends 82 of receiver arms 62,64, causing them to slightly open and releasing the striker portions.

End walls 18, 20 also include an alignment area having two generally horizontal and parallel rib members 84 defining a space 86 therebetween. When assembled, alignment member 60 of the receiver is disposed between parallel rib members 84. The latch striker area includes a generally vertical member 98 (FIG. 2) disposed in an assembled orientation between striker 72 and the interior surface of side walls 14,16 for enhancing lateral retention between adjacent walls.

As illustrated in FIG. 1, sidewalls and end walls also have an upper surface with a rib pattern and a plurality of ribs 100 disposed thereon (both externally and internally) for providing strength. Some ribs 102 are concentrated directly above handle openings 104. Base 12 also includes upstanding side flanges 90,92 for mating with sidewalls 14,16 and upstanding end flanges 94,96 for mating with end walls 18,20. Side flanges 90,92 have an external surface with a plurality of recessed areas 106 and a plurality of pockets 108 which are downwardly directed, where the openings 109 of pockets 108 receive the upwardly extending projections 110 of side walls 14,16 when in an assembled orientation. The outer surface of pockets 108 are generally co-planar with the wall outer surface.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A collapsible container comprising:

a base having a lower hinge portion including a first lower hinge portion and a second lower hinge portion; and a plurality of upstanding side walls attached to the base and having an upper hinge portion extending downwardly therefrom, the upper hinge portion including an elongate first upper hinge portion and an elongate second upper hinge portion, wherein the first lower hinge portion of the base includes a first opening for receiving the first upper hinge portion therein and also including a flange for securing the first upper hinge portion thereunder, and wherein the second lower hinge portion includes a support surface below a second opening correspondingly sized for receiving the second upper hinge portion therein and the second lower hinge portion includes an upward protrusion adjacent the support surface on an interior side of the support surface for limiting lateral movement of the side wall relative to the base toward an interior of the container in a direction perpendicular to an axis about which the side wall pivots relative to the base, and wherein the flange is deflected in a plane generally perpendicular to the axis upon insertion of the first upper hinge portion into the first lower hinge portion in a direction not parallel to the axis about which the side wall pivots relative to the base, and wherein at least one of the upstanding sidewalls has a latch striker portion and an adjacent one of the upstanding sidewalls has a latch receiver portion for receiving the latch striker portion when the container is in its assembled orientation.

2. The collapsible container of claim 1, wherein the second upper hinge portion has a cylindrical cross-section.

3. The collapsible container of claim 1, wherein the second upper hinge portion is disposed adjacent the first upper hinge portion.

4. The collapsible container of claim 1 wherein the flange of the first lower hinge portion extends downwardly.

5. The collapsible container of claim 4 wherein the flange includes a lowermost edge for abutting the first upper hinge portion.

6. The collapsible container of claim 4 wherein the first upper hinge portion includes a flat surface, the flat surface abutting and deflecting inwardly of the container the flange during insertion of the first upper hinge portion into the first lower hinge portion.

7. The collapsible container of claim 6 wherein the first upper hinge portion has an elongated cross-section that permits insertion of the first upper hinge portion into the first lower hinge portion when the first upper hinge portion is in a first rotational position relative to the first lower hinge portion and retains the first upper hinge portion to the first lower hinge portion when the first upper hinge portion is in a second rotational position relative to the first lower hinge portion, the second rotational position different from the first rotational position.

8. The collapsible container of claim 7 wherein the upper hinge portion includes at least one downwardly extending arm connected to the second upper hinge portion, the at least one arm abutting a portion of the second lower hinge portion to prevent movement in a direction axially along the second upper hinge portion.

9. The collapsible container of claim 8 wherein the at least one arm includes a pair of arms, each abutting the second lower hinge portion to prevent movement in both directions along the axis.

10. The collapsible container of claim 1 wherein the second lower hinge portion includes a concave support surface supporting the second upper hinge portion thereon.

11. The collapsible container of claim 10 wherein the second opening of the second lower hinge portion is correspondingly sized for receiving the second upper hinge portion therein and for limiting lateral movement between the side walls and the base in a direction generally parallel to a plane generally defined by the base.

12. The collapsible container of claim 1 wherein the first upper hinge portion is received in the first lower hinge portion in a direction at least substantially perpendicular to the axis.

13. The collapsible container of claim 1 wherein the upper hinge portion includes a pair of spaced-apart, downwardly extending arms connected proximate opposite longitudinal ends of the second upper hinge portion.

14. The collapsible container of claim 13 wherein each arm of the pair of arms abuts the second lower hinge portion to prevent movement in both directions along the axis.

15. The collapsible container of claim 1 wherein the second upper hinge portion is supported on the support surface of the second lower hinge portion and contacts the upward protrusion to limit lateral movement of the second upper hinge portion toward the interior of the container.

16. The collapsible container of claim 15 wherein the support surface is concave and opens upwardly.

17. A collapsible container comprising:

a base having a plurality of lower hinge portions; and a plurality of upstanding side walls pivotably attached to the base and having lower areas with upper hinge portions attached therewith in a unitary construction, the upper hinge portions received by the lower hinge portions in a secure manner, wherein one of the upstanding sidewalls has a latch receiver portion formed integrally therewith, the latch receiver portion having a receiving area defined by a plurality of beveled surfaces, and wherein an adjacent one of the upstanding walls has a latch striker portion having corresponding mating beveled surfaces for being received securely within the latch receiver portion to retain the adjacent one of the upstanding side walls in its assembled orientation, wherein the plurality of beveled surfaces on the latch receiver portion and the plurality of beveled surfaces on the latch striker portion each include three substantially planar surfaces extending at acute nonzero angles relative to one another.

18. The collapsible container of claim 17 wherein the latch striker portion snap-fits into the latch receiver portion when the adjacent one of the side walls is moved to an upright position.

19. The collapsible container of claim 17 wherein at least one of the beveled surfaces of the latch receiver portion and the latch striker portion is flexed upon insertion of the latch striker portion into the latch receiver portion.

20. The collapsible container of claim 17 wherein on the latch receiver portion and on the latch striker portion, the three substantially planar surfaces include a middle surface generally defining a plane and two side surfaces extending at acute nonzero angles relative to the plane.

21. The collapsible container of claim 17, wherein the latch receiver portion includes a pair of arms extending at an angle inwardly of the container and away from one another, and wherein at least one of the pair of arms includes an interference portion behind which the latch striker portion snaps when one of the side walls is moved to its assembled position.

22. The collapsible container of claim 21 wherein the latch striker portion includes a pair of outer surfaces angling inwardly of the container and away from one another, the pair of outer surfaces abutting the pair of arms when the container is in its assembled position.

23. The collapsible container of claim 22 wherein the latch receiver portion further includes a generally flat surface between the pair of arms abutting a generally flat outer surface between the pair of outer surfaces of the latch striker portion when the container is in its assembled position.

24. The collapsible container of claim 22 wherein the latch striker portion and latch receiver portion are a knock-down latch, such that they are unlatched by applying an external force to one of the adjacent walls, without manually actuating a release for the latch striker portion and latch receiver portion.

25. A collapsible container comprising:

a base having a lower hinge portion including a first lower hinge portion and a second lower hinge portion; and at least one side wall pivotably attached to the base and having an upper hinge portion extending downwardly therefrom, the upper hinge portion including an elongate first upper hinge portion having an axis and an elongate second upper hinge portion, wherein the first lower hinge portion of the base includes a first recess for receiving the first upper hinge portion therein in a direction not parallel to the axis of the first upper hinge portion and also including a stop portion for securing the first upper hinge portion thereunder, and wherein the second lower hinge portion includes a second opening for receiving the second upper hinge portion securely therein, wherein the second lower hinge portion includes an upwardly-opening concave support surface supporting the second upper hinge portion thereon and for limiting lateral movement between the side wall and the base while enhancing the pivotability therebetween, wherein the side wall is pivotable about a pivot axis relative to the base, and wherein the stop portion is deflected in a direction generally perpendicular to the pivot axis upon insertion of the first upper hinge portion into the first lower hinge portion.

26. The collapsible container of claim 25 wherein the stop portion of the first lower hinge portion extends downwardly.

27. The collapsible container of claim 26 wherein the stop portion includes a lowermost edge for abutting the first upper hinge portion.

28. A collapsible container comprising:

a base having a lower hinge portion including a first lower hinge portion and a second lower hinge portion; and a plurality of upstanding side walls attached to the base, each side wall pivotable about an axis and having an upper hinge portion extending downwardly therefrom, the upper hinge portion including an elongate first upper hinge portion and an elongate second upper hinge portion, wherein the first lower hinge portion of the base includes a first opening for receiving the first upper hinge portion therein and also including a flange for securing the first upper hinge portion thereunder, such that the flange is deflected in a plane generally perpendicular to the axis upon insertion of the first upper hinge portion into the first lower hinge portion in a direction not parallel to the axis, and wherein the second lower hinge portion has a recess that includes a second opening for receiving the second upper hinge portion therein, the second lower hinge portion further including an upward protrusion adjacent the recess on an interior side of the second opening, the upward protrusion limiting lateral movement of the second upper hinge portion toward an interior of the container.

* * * * *